US005264817A

United States Patent [19]

Sorenson

[11] Patent Number: 5,264,817

[45] Date of Patent: Nov. 23, 1993

[54] THERMAL CIRCUIT PROTECTIVE DEVICE

[76] Inventor: Richard W. Sorenson, 6540 SE. Harbor Cir., Stuart, Fla. 34996

[21] Appl. No.: 16,714

[22] Filed: Feb. 11, 1993

[51] Int. Cl.[5] ..... H01H 71/16

[52] U.S. Cl. ..... 337/68; 337/79; 337/91

[58] Field of Search ..... 337/66, 68, 74, 77, 337/79, 91

[56] References Cited

U.S. PATENT DOCUMENTS 5,089,799 2/1992 Sorenson ..... 337/68

*Primary Examiner*—Harold Broome

*Attorney, Agent, or Firm*—McCormick, Paulding & Huber

[57] ABSTRACT

In a single housing that looks like a standard rocker switch a thermally responsive movable contact element is mechanically opened by the rocker in a "switch" mode, or opened in response to an overcurrent condition in a circuit protection mode. Both conditions result in a trip flag being moved between the movable and a fixed contact. The trip flag rests lightly on the movable contact when the device is ON and during reset motion the trip flag is so mounted in the switch case that it reaches such a reset position only after the movable contact has returned to its ON or closed condition. The rocker has skirts that define cam teeth cooperable with cam teeth on the trip flag. The housing defines slots for receiving projecting portions of the trip flag to define a movable pivot for the trip flag to so reduce the forces and/or moments of the trip flag as it "rests" on the movable contact.

8 Claims, 5 Drawing Sheets

PRIOR PATENT

THERMAL CIRCUIT PROTECTIVE DEVICE

This invention relates generally to thermal circuit protectors, and deals more specifically with a device comprising an improvement over the thermal switch/-breaker described in U.S. Pat. No. 5,089,799, which patent is incorporated by reference herein.

BACKGROUND OF THE INVENTION

U.S. Pat. No. 5,089,799 discloses an electric rocker switch capable of both conventional switch operation and of thermal operation also. The thermally responsive movable contact element may be mechanically closed against the fixed contact, but is also movable by bimetallic thermal action to an open condition when an overcurrent condition exists. A trip flag is provided for movement between the open contacts whenever the switch rocker is moved to OFF, and will remain in this position if an overcurrent condition exists even if the rocker is held ON. Thus, trip free operation is achieved provided only that the flag first move between these contacts. A return spring is provided for the trip flag so that a positive action occurs as the flag moves between the contact. The same spring also holds the rocker in its ON position, and in addition this spring serves to hold the trip flag against the movable contact in the switch ON condition.

The general purpose of the present invention is to provide for an improved trip flag configuration such that the trip flag rests lightly on the movable contact of the bimetallic element, which trip flag is also designed to continue to bear only lightly on the movable contact when the rocker is moved from the ON position toward the OFF position.

One object of the present invention is to provide a trip flag mechanism whereby when the rocker is actuated from the ON position to the OFF position, the resulting forces thereby generated through the trip flag against the movable contact are either nonexistant or absolutely minimal. This is accomplished during rocker actuation to OFF by having a pivot point for the trip flag against the breaker base at a point higher than a line drawn between the point of pressure of the trip flag against the contacts and the point of pressure between the rocker and the trip flag.

Another object of the invention is to provide a trip flag mechanism that assures an initial rotating downward action of the trip flag prior to assuring the occurrence of a sliding downward action when the rocker is actuated from the OFF position to the ON position, thereby allowing for the contacts to come together to the ON position prior to the rocker cam being able to pass over the trip flag cam and then be latched in the ON position. This is accomplished during actuation to ON by having a different, lower pivot point for the trip flag against the breaker base than the pivot point that is engaged when the rocker is actuated from the ON position to the OFF position; this lower pivot point is configured to change its point of contact against the base as the trip flag rotates to assure the downward movement of the cam area once the trip flag has rotated adequately to allow the contacts to come together.

SUMMARY OF THE INVENTION

In accordance with the present invention an electrical circuit protector is provided in a generally rectangular housing having an upwardly open cavity for receiving a pivotably mounted rocker. The rocker is designed to mechanically cam a bimetallic temperature responsive spring element so that the device can be used in a simple switch mode. A trip flag is moveably supported in the housing so that one portion of the flag is adapted to rest against the movable contact when the movable contact closes on a fixed contact. This one flag portion is also adapted to move between the movable and fixed contacts when the switch is open.

The trip flag has a cam lobe or tooth defined adjacent an opposite end portion, and this trip flag tooth is engageable by a cam lobe or tooth on the pivoting rocker to create compound movement of the trip flag from a rest position where the flag rests against the movable contact to a cocked position wherein the flag is spaced from the movable contact and the fixed contact. Biasing means is provided for urging the trip flag opposite end portion into contact with the actuator's cam lobe or tooth, and this biasing means also urges the one flag portion toward its active position to rest against the movable contact, or to move between the fixed and movable contacts when the device is tripped due to an overcurrent condition or mechanically switched OFF manually.

The trip flag has projecting portions that are received in a slot defined by the housing, and the trip flag is not only capable of pivotal movement relative to a first point on the slot side wall, but the trip flag is also designed to provide a changing pivot point in combination with the vertical movement within the slot. The trip flag and rocker can be moved not only into the above mentioned cocked position, but in the embodiments described herein the trip flag can be moved into abutting relationship with closed movable contact both during the reset motion of the rocker and in the normal ON position of the rocker. The embodiments of the invention are otherwise similar to the structure disclosed in the above mentioned U.S. Pat. No. 5,089,799. The trip flags described herein impact the movable contact with a negligible force, or at least a lighter force than was possible in the device of the '799 patent.

BRIEF DESCRIPTION OF THE DRAWINGS

FIG. 5 is a vertical section taken through an alternative embodiment of the invention, the rocker and trip flag being reset to ON.

DETAILED DESCRIPTION OF FIGS. 1-4

Figure 4:
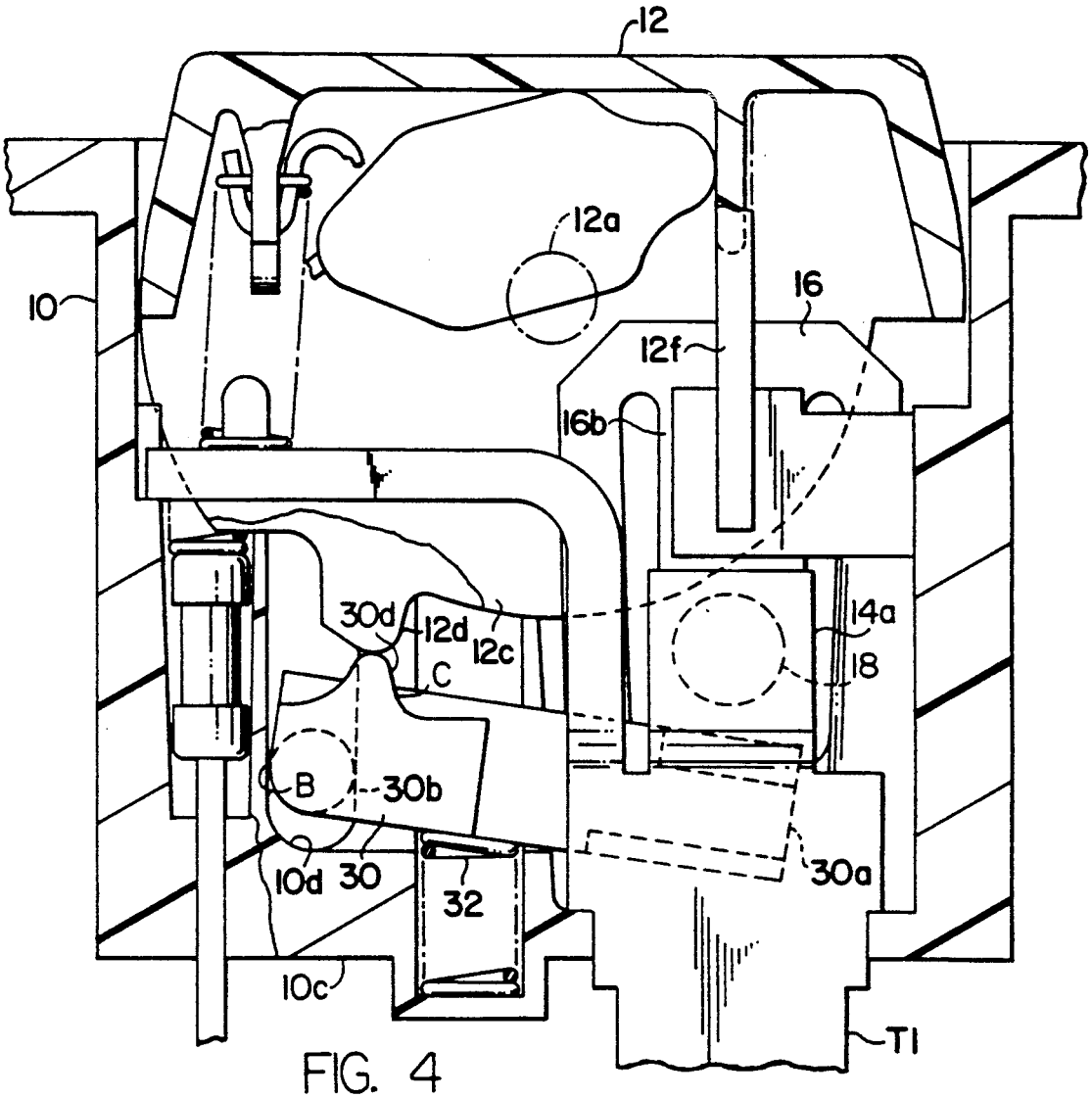
FIG. 4 is a vertical section taken through the switch/-breaker of U.S. Pat. No. 5,089,799 illustrating the rocker and trip flag in an intermediate position between the OFF and ON positions.
Figure 6:
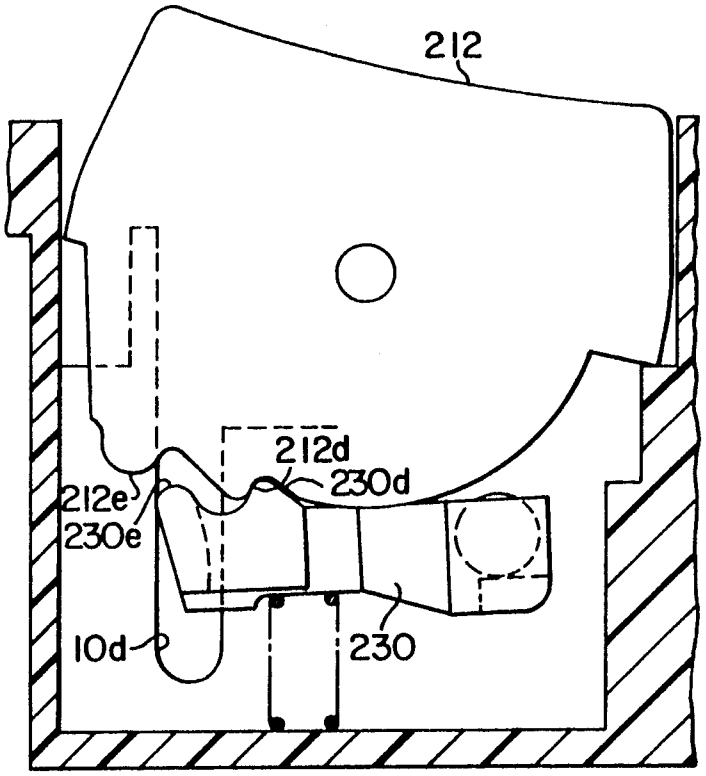
FIG. 6 is a view similar to FIG. 5, but illustrating the rocker in its OFF position, and the flag in its normal OFF position.

Turning first to a description of the switch/breaker illustrated in FIG. 4, the housing 10 is upwardly open and a pivoted rocker 12 is provided in the opening by conventional pivot means, which means preferably comprises laterally projecting axle portions such as illustrated at 12*a* that are in turn received in openings (not shown) provided for this purpose in the side walls of the housing 10.

A bottom wall 10*c* of the housing 10 defines openings for at least two terminals T1 and T2 (the latter not being apparent in this view). Terminal T1 is electrically connected to a fixed contact 14 inside the switch housing 10 and more specifically on a tab 14*a* integrally defined by the terminal T1. The second terminal T2 is located directly behind the terminal T1 and also has a portion extending inside the switch housing cavity where it is electrically connected to a lower end portion of a bimetallic temperature responsive element 16.

The bimetallic element 16 has a U-shaped slot 16*a* defined therein with the result that a tongue portion 16*b* is adapted to deform elastically in response to a predetermined temperature rise of the bimetallic material from which it is made. This tongue portion 16*b* moves between the positions described for it in U.S. Pat. No. 5,089,799 and a movable contact element 18 is provided at the end of the arm 16*b* for movement toward and away from the fixed contact 14 described previously. This element 16 is sometimes referred to as a "Taylor" blade and is available from Demich Industries, 70 Mill Street, Johnston, R.I. 02919.

The disclosure in the above mentioned U.S. Pat. No. 5,089,799 has been incorporated by reference herein, and FIG. 4 provides a convenient reference thereto for purposes of gaining an understanding of the structure disclosed in the '799 patent. Thermal expansion of the bimetallic element 16 corresponds to opening movement of the contact 18, and in addition mechanical opening movement of the contact 18 is also possible simply by pivoting the rocker 12 to and from its ON and OFF positions as described in the '799 patent. The rocker 12 has a tapered cam surface 12*f* provided on a depending portion of the rocker which is adapted to achieve mechanical deformation of the tongue 16*b* for opening movement of the movable contact 18 as a direct result of pivoting movement of the rocker. Closing movement of the contact 18 is achieved by the inherent resiliency of the tongue 16*b*.

Still with reference to the rocker 12 relatively deep side walls or skirts 12*c*, 12*c* each define a depending cam lobe or tooth 12*d* that cooperates with a generally similarly shaped tooth provided for this purpose on the upper edge of the trip flag 30. One end portion 30*a* of the trip flag 30 is adapted to move from the position shown for it in FIG. 4 to a position between the fixed contact 14 and the movable contact 18. As described in the '799 patent the trip flag 30 normally rests lightly on the lower edge of movable contact 18, with spring biasing means 32 provided between the lower wall of the housing 10 and the underside of the trip flag 30 for urging the trip flag from the cocked position shown in FIG. 4 to a position between these fixed and movable contacts 14 and 18 respectively.

In the switch of FIG. 4, and as described in the '799 patent itself, the trip flag 30 has an opposite end with axle defining portions 30*b* that are pivotably provided in elongated slots 10*d* of the housing 10 so that the trip flag is adapted to pivot between the positions described above, and so that the trip flag also translates in the slot 10*d* all as described in the '799 patent.

Figure 2:
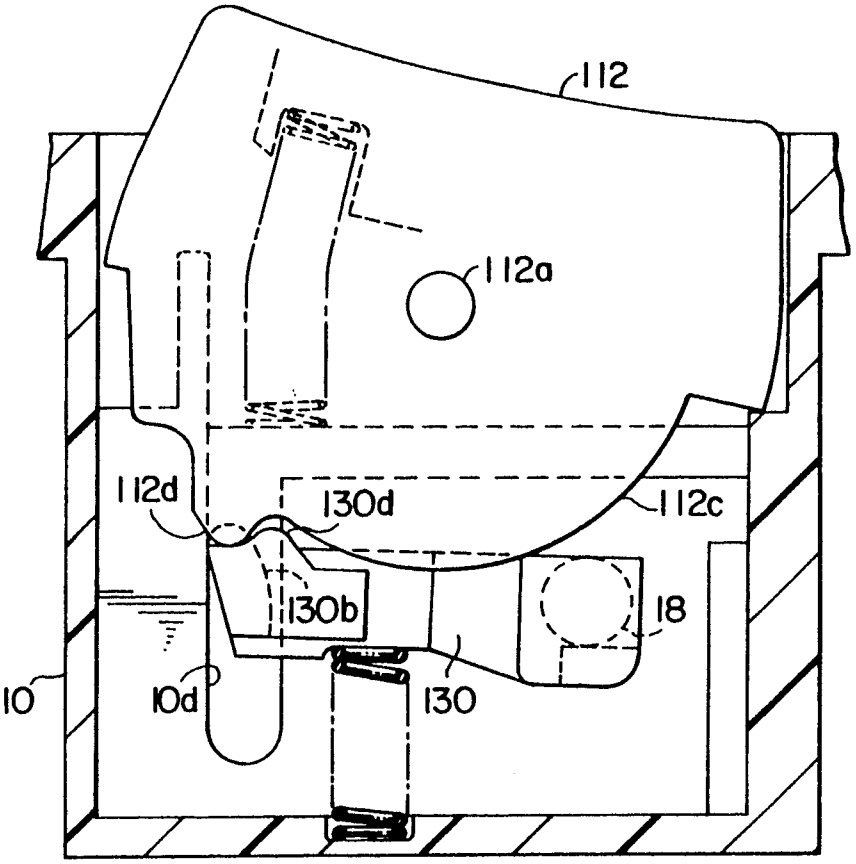
FIG. 2 is a view similar to FIG. 1, but illustrating the rocker in its OFF position and the trip flag in its active position.
Figure 1:
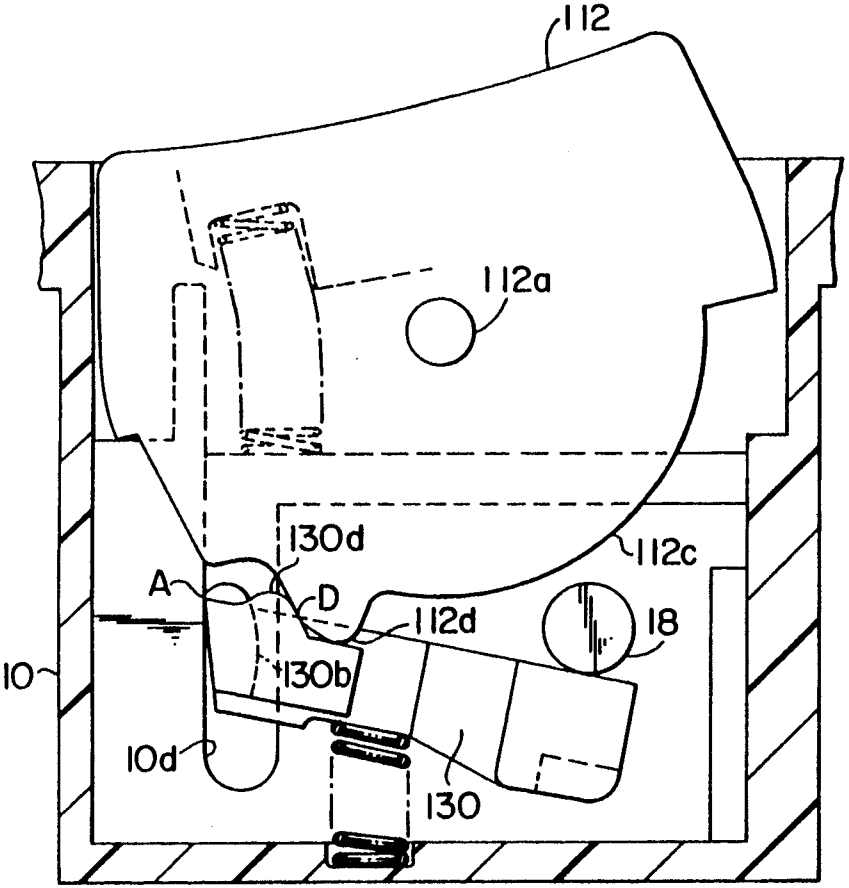
FIG. 1 is a vertical section taken through a circuit protective device constructed in accordance with the present invention, the rocker and trip flag being in the ON and rest positions respectively.
Figure 3:
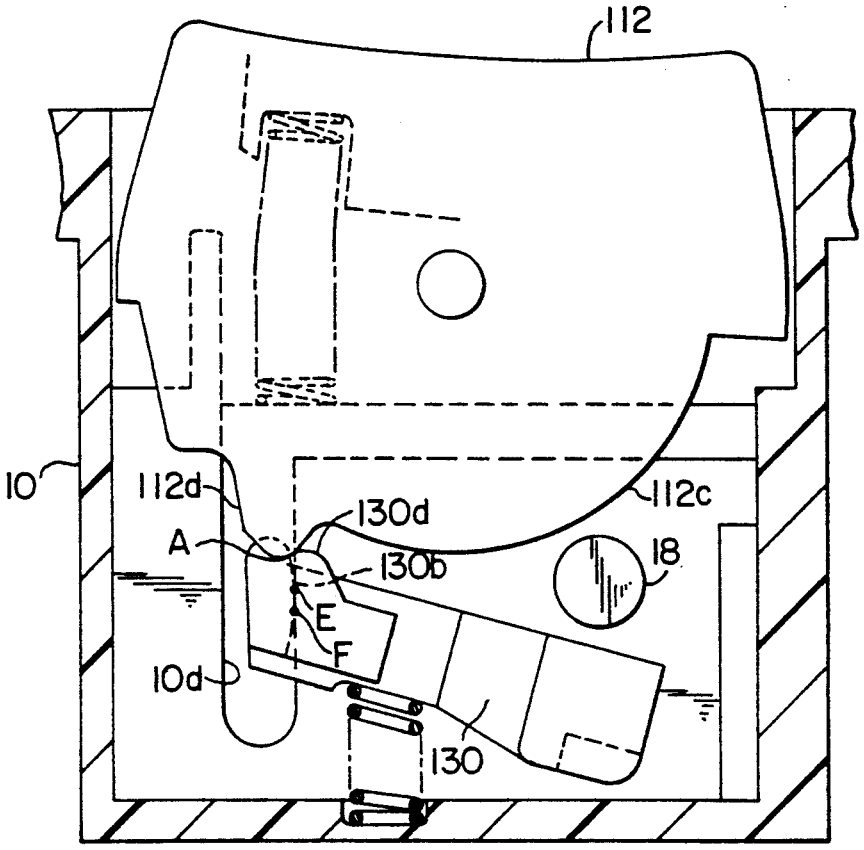
FIG. 3 is a view similar to FIGS. 1 and 2, but illustrating the rocker and trip flag in an intermediate "moving to reset" positions between the OFF and ON positions of FIGS. 2 and 1 respectively.

Turning now to a detailed description of FIGS. 1-3 inclusively the switch housing 10 may be generally similar to that described above with reference to FIG. 4, and also includes elongated slots 10*d*, 10*d* for loosely receiving projecting portions 130*b*, 130*b* of a trip flag 130 having many similarities to the trip flag 30 of the '799 patent and FIG. 4, but also including additional features to be described.

A rocker 112 is provided in the upwardly open housing 10 for pivotal movement about axle defining portions 112*a* much the same as those described with reference to the rocker of FIG. 4. That is, rocker 112 includes a depending leg similar to the leg 12*f* referred to in FIG. 4. An intermediate coupling device (not shown) provides for corresponding movement of the tongue portion 16*b* of the bimetallic contact element 16, which element 16 may be similar to the element 16 provided in the device of the '799 patent.

The rocker 112 also includes depending skirts 112*c*, 112*c*, each of which skirts defines a depending cam lobe or tooth 112*d* similar to that described previously with reference to FIG. 4. Each tooth has a crown between front and rear faces. Such cam lobe teeth comprise cam surfaces in the present disclosure and claims.

The trip flag 130 like the trip flag 30 of FIG. 4 is adapted to be moved from the rest position of FIG. 1 to the active position of FIG. 2 as the rocker 112 is physically moved between its ON and OFF positions respectively. A cam lobe tooth 130*d* on the trip flag 130 is engaged by the depending cam lobe tooth 112*d* of the rocker 112 for achieving this motion of the trip flag 130.

Unlike the structure of the '799 patent and FIG. 4, however, the structure of FIGS. 1-3 provides for significant reductions in the forces transmitted to the movable contact 18 by the end portion of the trip flag 130, not only in the at-rest ON position shown for it in FIG. 1, a position in which the rocker is under steady pressure by a biasing spring to return it to the OFF position, but also during initial actuation of the rocker 112 from the ON position to the OFF position. During initial actuation from the ON position to the OFF position, the rocker, prior to disengaging from the trip flag cam by forcing the trip flag cam downward, transmits additional force from the rocker cam 112*d* against the trip flag cam 130*d*, an additional force which is now transmitted totally through the trip flag to the side of the slot in the base, point A FIG. 1, unlike the structure of the '799 patent in which a portion of the additional force is transmitted through the trip flag 130 against the movable contact 18. More particularly, it will be apparent that the trip flag 130 has projecting portions 130*b*, 130*b* at an end opposite the portion movable between the fixed 14 and movable 18 contacts. These portions 130*b*, 130*b* engages the left hand side wall of the slots 10*d*, 10*d* both in the ON position of FIG. 1, and the OFF position of FIG. 2. Point A is located generally on a line passing through the point of contact D between the rear face of the cam lobe tooth 112*d* on the rocker and the front face of the cam lobe tooth 130*d* on the trip flag. Such a line also passes slightly above the point of engagement between the end portion of the trip flag 130 and the movable contact 18. The generally linear geometry of these points assures that the forces and/or moments exerted by the trip flag 130 on the movable contact 18 are either eliminated or at least minimized in the FIG. 1 ON position.

The foregoing result is to be contrasted with that achieved by the configuration for the trip flag 30 of FIG. 4. Note that the axle defining portion 30*b* of FIG. 4 engage the side wall of the slot 10*d* at a point B which defines a line of action well through the contact area C between the upstanding tooth 30*d* of the trip flag 30 well above the underside of the movable contact 18 which is engaged by the trip flag end portion in the ON position all as described in detail in the '799 patent. Such geometry leads to excessive loads on the movable contact 18 in FIG. 4.

Another way of describing the invention is to note that the contact area D between the tooth 112*d* of the rocker and the tooth 130*d* of the trip flag is actually slightly below a line drawn between the pivot point A of the trip flag 130 and the underside of the movable contact 18 which is engaged by the end portion of the trip flag as shown in FIG. 1. This geometry, whereby the latching point D is slightly below such a line between the movable contact 18 and the pivot or contact point A at the left hand end of the rocker 130 and the side wall of the slot 10*d*, assures that mechanical movement of the rocker 112 from the position shown in FIG. 1 toward the OFF position of FIG. 2 will not exert excessive, forces on the movable contact 18.

With reference to FIG. 3, the trip flag projection can be seen to engage the side of the slot opposite the side associated with point A, and that such engagement achieves a range of pivot points for the trip flag projection between the points indicated generally at E-F in this view. Thus, as the trip flag rotates in a direction from OFF to ON the engagement between the trip flag portion and the movable contact is forestalled. The convex surface of the trip flag projection indicated generally at E-F achieves this range of pivot points.

DETAILED DESCRIPTION OF FIGS. 5–8

FIGS. 5 through 8 illustrate an alternative embodiment of the invention wherein the rocker switch is provided with two cam lobes or teeth that operate in conjunction with two teeth defined on the trip flag so as to afford two different configurations for the rocker and trip flag when the latter rests against the movable contact. Compare for example, FIGS. 5 and 8.

Advantage is taken of the rolling contact between the trip flag and the right hand side of the slot defined by the case so as to afford these two different positions for the trip flag when the flag is in its rest position.

Figure 5:
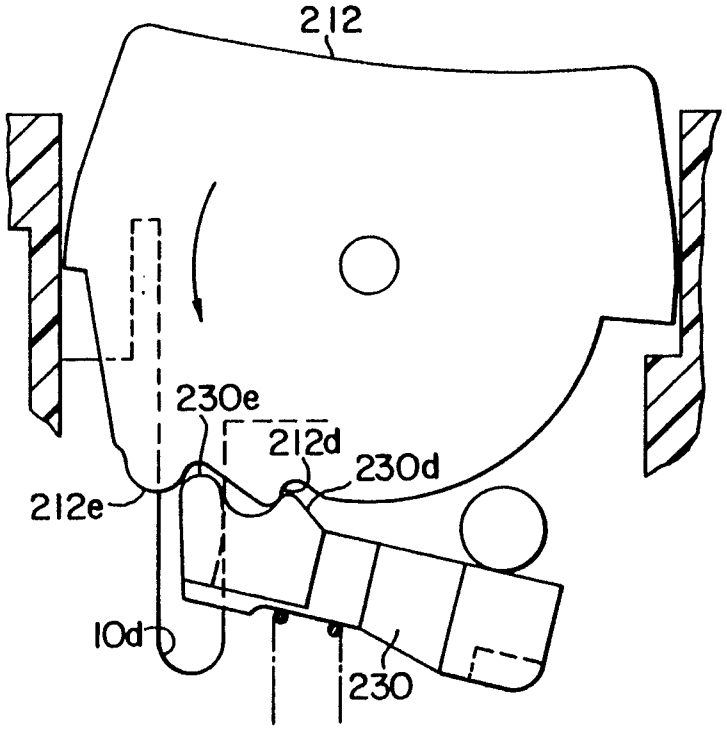

More specifically, the rocker 212 of FIG. 5 is shown in the process of resetting the device to ON, this view being an intermediate position for the rocker and trip flag and showing the first of the two teeth on the rocker 212*d* engaging the first of the two teeth on the trip flag 230. Note that the convex contour for the trip flag portion that is received in the slot 10*d* provides much the same action for the trip flag as described hereinabove with reference to FIG. 3 of the first described embodiment of FIGS. 1, 2 and 3.

Figure 8:
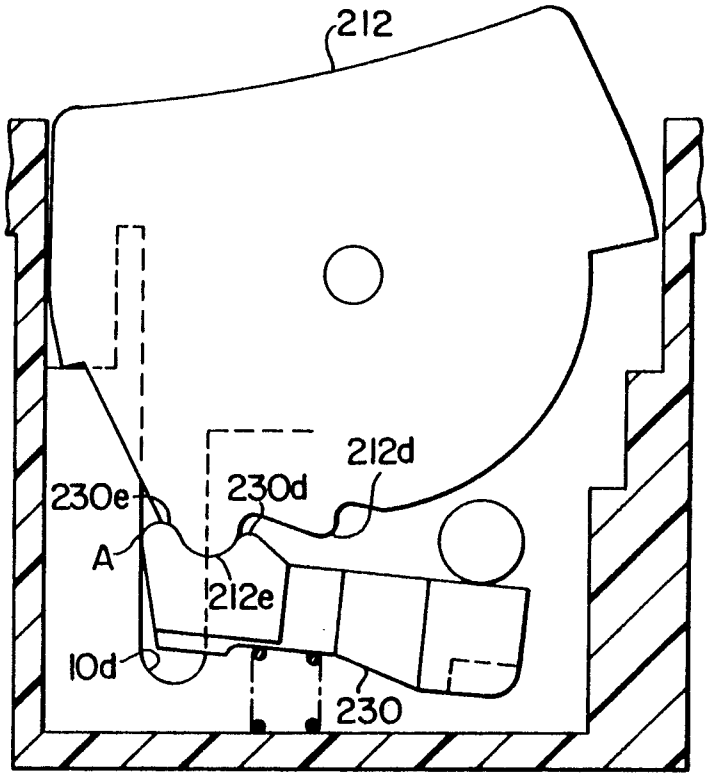
FIG. 8 is a view similar to FIGS. 5 through 7, but illustrating the rocker in its ON position and the trip flag in a rest position.

Turning next to a description of the actual On position, FIG. 8 illustrates the rocker 212 in its ON position, and trip flag 230 having the second of its two teeth 230*e* engaging the second tooth 212*e* of the rocker, and more particularly such that this second tooth of the rocker is actually received between the two teeth 230*d* and 230*e* of the rocker 230.

Still with reference to FIG. 8 it will also be apparent that the rocker 212 in the ON position has its projecting portions as provided slidably in the slot 10*d* of the case so located that the pivot point for the trip flag against the side of the slot is located at A as described previously with reference to FIG. 1 in the first embodiment.

Turning now to a description of the OFF position for the device of FIGS. 5, 6, 7 and 8, FIG. 6 shows the rocker 212 having its first tooth 212*d* engaging the rear face of the first tooth 230*d* in much the same manner as is true of the rocker and trip flag 112 and 130 as illustrated in FIG. 2 for the first embodiment.

Figure 7:
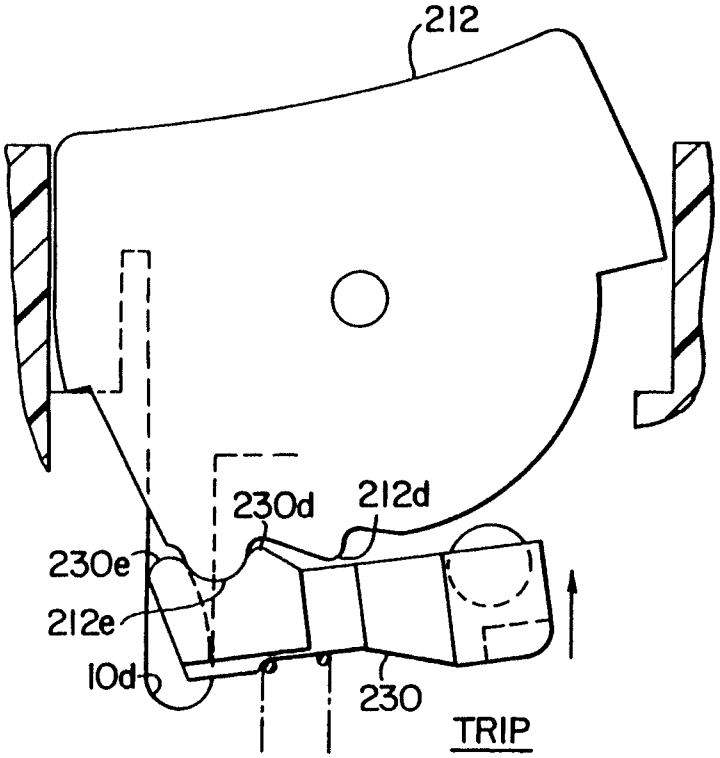
FIG. 7 is a view similar to FIGS. 5 and 6, but illustrating the rocker in its OFF position, and the trip flag moving into its active or "tripped" position.

Finally, FIG. 7 shows the device in the early stages of being tripped by the thermal action of the movable contact, as in case of a current overload. The flag 230 is partially tripped and has moved toward its active position between the movable and fixed contacts (see FIG. 6), but the rocker 212 has not yet moved out of the ON position because of the fact that the rocker return spring cannot perform its function (to return the rocker to ON) until after the spring biased flag 230 has pivoted beyond the FIG. 7 partially tripped position.

I claim:

1. An electrical circuit protective device comprising:

a housing;

an actuator supported in said housing for movement between ON and OFF positions, said actuator having a cam surface;

a fixed contact in said housing;

movable contact means in said housing and including a bimetallic temperature responsive spring element having a fixed portion and a movable portion, a movable contact on said movable portion and normally held against said fixed contact by the inherent resiliency of said spring element, said movable portion being biased away from said fixed contact by the inherent temperature responsive characteristics of said bimetallic spring element due to an overcurrent condition;

a trip flag movably supported in said housing for movement between a rest position wherein a portion of said flag rests against said movable contact and an active position wherein said flag portion lies between said movable and fixed contacts;

slot means defined by said housing;

said trip flag defining at least one projecting portion provided slidably in said slot to provide for said flag movement, both pivotally and in the direction of said slot between said rest and active positions, and said slot loosely receiving said trip flag projecting portion to permit limited movement of said flag transversely of said slot from one side to an opposite side;

said trip flag having a cam lobe tooth defined adjacent said trip flag projecting portion in the direction transversely of said slot, and said trip flag tooth being engaged by said actuator cam surface to cause movement of said trip flag out of said rest position with minimal trip flag forces on said movable contact;

biasing means urging said trip flag tooth into contact with said actuator first cam surface and urging said flag portion toward said active position between said fixed and movable contacts.

2. The combination according to claim 1 wherein said biasing means also acts through said tooth and said cam surface to define a stable ON position for said actuator.

3. The combination according to claim 1 wherein said cam surface of said actuator comprises a tooth-like projection (tooth) having a crown and a front and a rear face, and said trip flag cam lobe tooth having a crown and a rear and front faces for engagement by said actuator tooth front and rear faces respectively, said trip flag projection engaging one side of said slot at a point (A) such that said trip flag tooth front face is engaged by said actuator tooth rear face generally on a line through said point (A) and through an engagement point between said movable contact and said trip flag portion when in said rest position against said movable contact.

4. The combination according to claim 3 wherein said trip flag projection engages an opposite side of said slot along a range of points (F-E) such that said trip flag rotates in a direction that forestalls engagement between said trip flag portion and said movable contact during actuator movement from OFF to ON.

5. The combination according to claim 2 wherein said actuator is a rocker pivotably supported in said housing and having depending side skirts defining two such cam surfaces, each such cam surface comprising a toothlike projection (tooth) having a crown and front and rear faces, said trip flag having two said projecting portions and two said trip flag teeth for engagement by said two teeth so defined by said two side skirts of said rocker.

6. The combination according to claim 5 wherein said cam surface of said actuator comprises a tooth-like projection (tooth) having a crown and a front and a rear face, and said trip flag cam lobe tooth having a crown and a rear and front faces for engagement by said actuator tooth from and rear faces respectively, said trip flag projection engaging one side of said slot at a point (A) such that said trip flag tooth front face is engaged by said actuator tooth rear face generally on a line through said point (A) and through an engagement point between said movable contact and said trip flag portion when in said rest position against said movable contact.

7. The combination according to claim 6 wherein said trip flag projection engages an opposite side of said slot along a range of points (F-E) such that said trip flag rotates in a direction that forestalls engagement between said trip flag portion and said movable contact during actuator movement from OFF to ON.

8. The combination according to claim 7 wherein said trip flag projection portions define convex surfaces for contacting said slot opposite side to achieve said range of pivot points (E-F).

* * * * *